FROTH SEPARATION APPARATUS

This invention relates to froth separation apparatus and particularly to apparatus for creating and separating froth from a fluid suspension such as is used in froth flotation processes.

The use of froth flotation techniques for separating one member of a mixture of materials in suspension is old and well known in the mineral dressing and related arts. Froth flotation is a technique used in separating a great variety of metal values from the gangue or tailings. Similarly, a great variety of apparatus has been used to accomplish this froth flotation separation. In general, these apparatus provide a means for introducing into a liquid suspension a frothing agent capable of forming an air bubble and attaching it to the material which is desired to be separated by flotation so that as the air bubbles rise to the top of the suspension they carry the material onto the top of the suspension in a floating froth. Usually such apparatus takes the form of a long trough with some means for introducing the suspension to be treated at one end along with the frothing agent and then introducing air into the system along the trough length to create a floating froth and finally skimming the froth from the suspension at the discharge end of the trough.

The conventional apparatus of the prior art is thus generally quite long and requires a considerable amount of space as well as being generally expensive to construct.

I have invented a froth separation apparatus which is simple in operation and construction and eliminates many of the problems of earlier froth separation devices.

I provide an apparatus which comprises a separation container of generally rectangular form having two spaced generally parallel vertical side walls, two generally parallel end walls and a bottom, influent feed means delivering influent suspension at spaced points along the top of the separation container, a reagent inlet into the influent feed in advance of the separation container, diagonal screen means extending across the separation container from end to end and from a line intermediate the top and bottom of one side wall to a line adjacent the bottom of the other side wall, froth creating means in the separation container above said screen means, a froth discharge means on said other side wall at the bottom thereof between said screen means and said other side wall, and outlet means at the bottom of said one side for tailings discharge. Preferably, the froth creating means is an agitating and aerating means such as a plurality of substantive parallel screens extending across the separation container above the screen means onto which the influent feed delivers the suspension of solids and liquids. The froth discharge means is preferably a weirtype discharge at the bottom of said other side, extending along the bottom of said other side from end to end. Preferably, the screen means extends to a line on the bottom adjacent said other side. The bottom preferably slopes away from said line where the screen means terminates to the effluent discharge opening.

In the foregoing general description of my invention I have set out certain objects, purposes and advantages. Other objects, purposes and advantages will be apparent from a consideration of the following description and the accompanying drawings in which.

Figure 1:
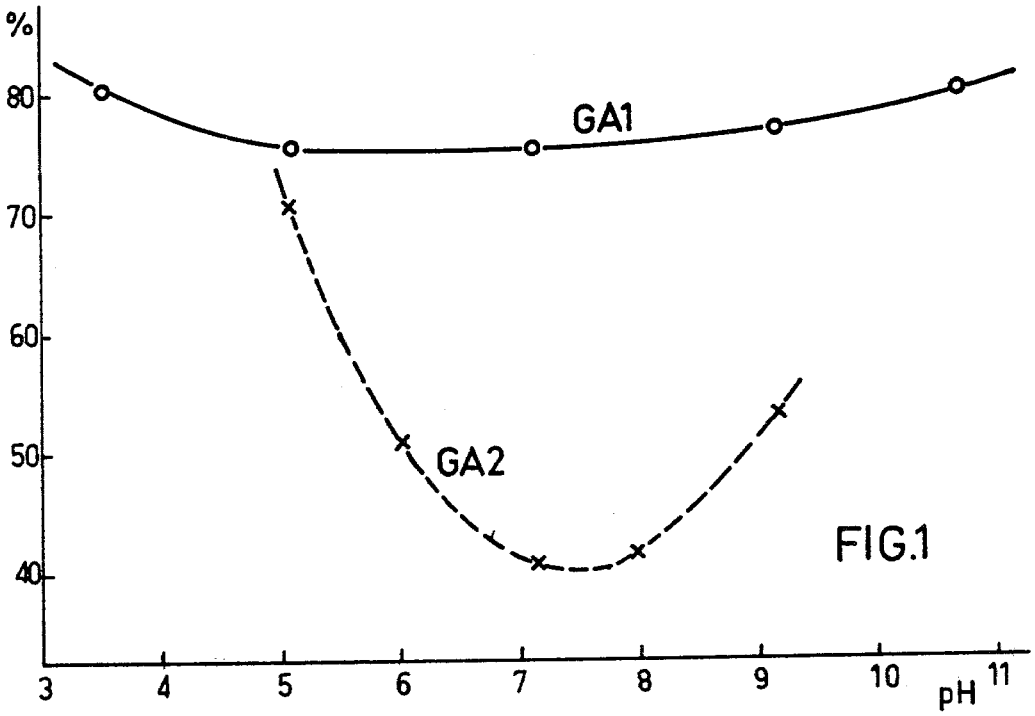
FIG. 1 is a side elevational view of an apparatus according to this invention from the effluent or tailings discharge.

Referring to the drawings I have illustrated a separation container 10, having an influent line 11 for delivering a suspension of mixed solids in liquid to be separated. The influent line has a multiplicity of discharge openings 12 extending along the length of container 10. A reagent inlet 13 is provided in the influent line ahead of discharge openings 12 through which frothing and like reagents may be added to the suspension in line 11.

The separation container 10 is generally rectangular in shape having spaced generally parallel opposite side walls 14 and 15, generally parallel end walls 16 and 17, and a bottom 18. A cross flow screen 19 extends between end walls 16 and 17, diagonally across container 10 from a line 20 intermediate the top and bottom of side wall 15 to a line 21 on bottom 18 adjacent its junction with side wall 14, at an angle of about 30° with wall 15. A plurality of superimposed $\frac{3}{8}''$ screens 22, about $\frac{3}{8}''$ apart, extend transversely across container 10 above line 20 and the suspension leaving openings 12 passes successively through these screens where it is agitated and aerated to form a froth. The froth 23 is collected on cross flow screen 19 in froth chamber 24 while the tailings in suspension pass through screen 19 into a discharge chamber 25 from which they are discharged through discharge slot 26. The froth 23 slides down screen 19 and passes through weir slot 27 and up to discharge opening 28 which is connected to a vaccum to cause the froth to be drawn from chamber 24.

The apparatus of this invention is simple, relatively small in size and highly efficient both in forming froth and separating the froth and its desired components from the tailings. No apparatus known to us can provide such efficient froth recovery as the instant invention.

In the foregoing specification I have set out certain preferred practices and embodiments of my invention; however, it will be understood that this invention may be otherwise embodied within the scope of the following claims.

I claim:

1. A froth separation apparatus comprising a stationary separation container of generally rectangular form having two spaced generally vertical side walls, two spaced generally vertical end walls, a bottom wall and a top, influent feed means delivering a suspension of solids in liquid into the interior of said container at spaced points along the top of said container, a reagent inlet into the influent feed means ahead of said container, generally diagonal froth retention planar screen means extending across the separation container from end to end and from a line intermediate the top and bottom of one side wall to a line adjacent the bottom of the other side wall, froth creating means in said container above said screen means, froth discharge means on the said other side wall adjacent the bottom thereof and adjacent and above the screen means line adjacent the bottom of said other side wall for removal of froth and outlet means at the bottom of said one side for tailings discharge.

2. A froth separation apparatus as claimed in claim 1 wherein the side walls are substantially parallel and the end walls are substantially parallel.

PROCESS FOR THE FLOTATION OF SULFIDE ORES

DESCRIPTION

The present invention relates to collectors or flotation agents for the flotation of minerals. It relates particularly to a series of thio-organic compounds having a pronounced affinity for various minerals, particularly sulphides, enabling improvements to be made in the flotation of these substances.

Flotation, which has been of very great service in the enrichment of minerals and has attained an advanced degree of development at the present time, comprises the utilization of certain specific substances which are capable of rendering hydrophobic the mineral or minerals which are to be flotated. Such substances as are currently employed include xanthates, dithiophospates, dithiocarbamates, sulpho-succinamates, mercaptans, benzotriazole and mercaptobenzothiazole. Though some of these collectors give good results, there is still a desire to improve flotation, in order better to separate the desired minerals from their gangue and to obtain them in better yields and with better selectivity. Such an advance is realised by the present invention. It provides a new series of substances capable of serving as collectors in flotation, with improved yields of valuable species. While they are applicable to various kinds of minerals, the collectors according to the invention are particularly suitable for the separation of sulphide minerals, for example galena, chalcopyrite, argentite, chalcocite, covellite, pyrites and marcasite. Owing to their specificity of action, the substances according to the invention provide a good separation between certain minerals; for example, they permit the separation of chalcopyrite from pyrites or from blende more effectively than can be done with known collectors.

even acetylenic. Thus, the above formula can be of the type:

$$C_xH_y—S—C_{x1}H_{y1}—H,$$

$$C_xH_y—S—C_{x1}H_{y1}—OH$$

or $$C_xH_y—S—C_{x1}H_{y1}—COOR''$$

where R'' is H, a cation such as Na, K, $NH_4$, Ca etc. or a $C_1$ to $C_{18}$ hydrocarbyl group and more particularly a $C_1$ to $C_4$ alkyl group. In these formulae, x is an integral number from 2 to 20 and y is one from 2 to 41. $x_1$ is 1 to 18 and is always lower than x, while $y_1$ is 2 to 37 and is always lower than y. The compounds which are most preferred and also the easiest to produce are those in which $C_xH_y$ is a straight or branched $C_2$ to $C_{18}$ alkyl group, preferably a $C_6$ to $C_{18}$ alkyl group, while $C_{x1}H_{y1}$ is a $C_1$ to $C_6$ alkenyl group.

In one embodiment of the invention, one or more of the oxygen atcms attached to the $—C_{x1}H_{y1}—$ group is/are replaced by one or more sulphur atoms, which thus gives a thiol function $—C_{x1}H_{y1}—SH$ or a thio-ester or thio-acid $C_{x1}H_{y1}CSOR''$, $—C_{x1}H_{y1}—CSSR''$.

By way of example, very good collectors are constituted by sulphides in which R' is of the form:

$$—(CH_2)_n—OH \quad \text{or} \quad —(CH_2)_nCOOR''$$

where n can be from 1 to 18 and particularly 1 to 6, while R'' is a hydrocarbon group, particularly a $C_1$ to $C_{18}$ alkyl group.

Thus, among the flotation agents according to the invention, particular compounds are of the type $R—S(CH_2)_nOH$ or $R—S—(CH_2)_n—COOR''$, comprising substances such as, for example:

| | |
|---|---|
| $C_6H_{13}—S—CH_2CH_2CH_2OH$, | $C_8H_{17}—S—CH_2CH_2CH_2OH$, |
| $C_8H_{15}—S—CH_2CH_2OH$, | $C_{10}H_{21}—S—CH_2OH$, |
| $C_{12}H_{25}—S—CH_2CH_2OH$, | $C_{18}H_{37}—S—CH_2OH$, |
| $C_6H_{13}—S—CH_2—CH_2—CH_2—COOCH_3$, | $C_{14}H_{29}—S—CH_2CH_2COOC_2H_5$, |
| $C_{14}H_{29}—S—CH_2CH_2SH$, | $C_{14}H_{29}—S—CH_2CH_2COOH$, |
| $C_{12}H_{25}—S—CH_2CH_2COONa$, | $C_{16}H_{33}—S—CH_2CH_2CSSNH_2$, |
| $C_{12}H_{25}—S—CH_2CH_2CSOH$, | $C_{16}H_{33}—S—CH_2CH_2COOH$ etc. |

FIG. 1 represents a graph of the recovery rate for galena plotted as a function of the pH of the pulp.

Figure 2:
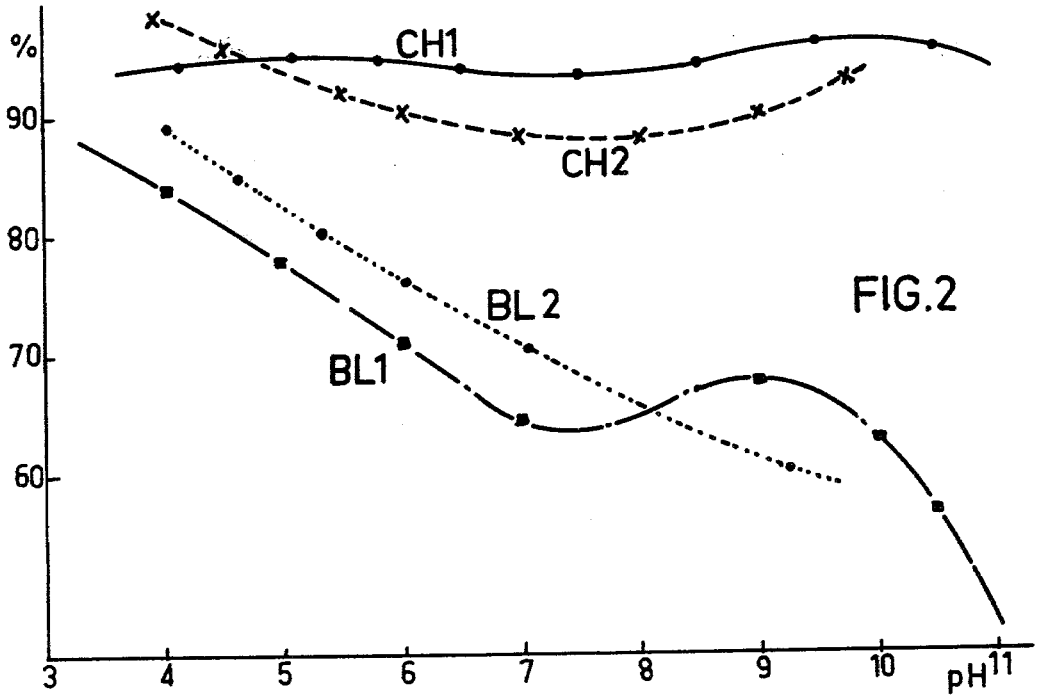
FIG. 2 is a section on the line II-II of FIG. 1.

FIG. 2 represents graphs of the recovery rates of chalcopyrite and blende as a function of pH.

Figure 3:
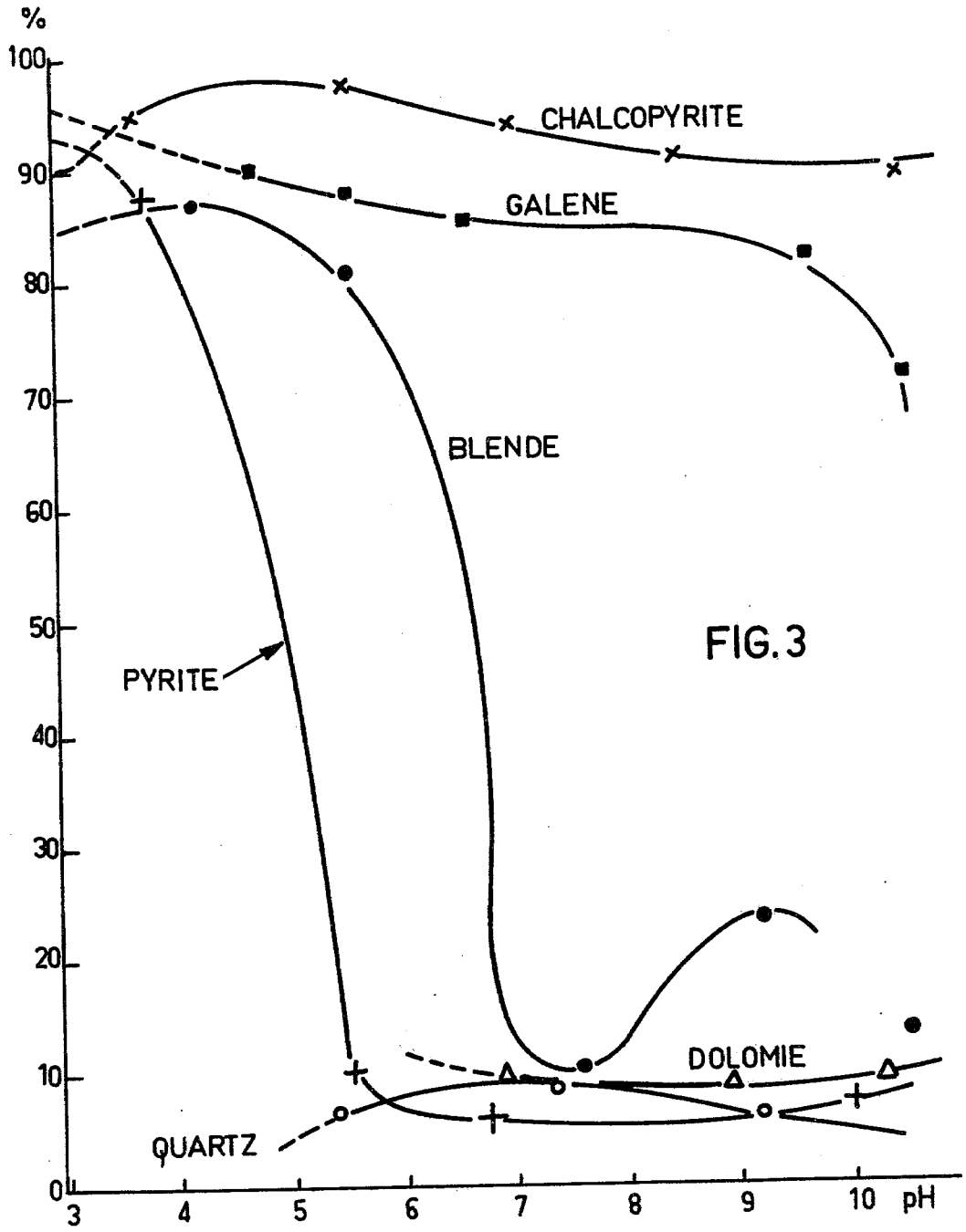
FIG. 3 is a side elevational view of the apparatus of FIG. 1 from the froth removal side.

FIG. 3 represents graphs showing the recovery rates of various sulfide ores including differences with respect to their corresponding gangues.

The collectors according to the invention are organic sulphides, particularly asymmetric dialkyl sulphides. Preferably, at least one of the organic groups, particularly one of the alkyl groups, carries a substituent of a different nature from these groups.

The flotation agents of the invention can be represented by the formula:

$$R—S—R'$$

in which the groups R and R' are different from one another and each can be a saturated or unsaturated organic radical, more particularly a $C_1$ to $C_{20}$ hydrocarbon radical. The latter can be acyclic, alicyclic or aromatic. The acyclic radicals can be aliphatic, ethylenic or The technique of flotation is well known to persons skilled in the art at the present time and thus does not need to be explained here. The collectors according to the invention are applicable within the scope of this known technique, so that it is unnecessary to change the conditions employed.

The collectors according to the invention can be employed in very low proportions. It is generally sufficient to provide 10 to 500 ppm with respect to the mineral undergoing flotation and most often about 30 to 200 ppm or 30 to 200 g/tonne. In relation to the volume of the pulp to be treated, this proportion is $0.5\times10^{-4}$ to $25\times10^{-4}$ g/l or 0.05 to 2.5 ppm.

An important factor in the application of flotation adjuvants is the pH of the pulp of the minerals to be treated. For each particular collector in its application to a given mineral under predetermined conditions, there generally corresponds an optimum pH which the skilled person will have no difficulty in establishing. Most often, the rates of recovery of numerous minerals are higher at low pH values, particularly at or below 5. For certain minerals, for example pyrites, the rate drops sharply at pH values above 7, particularly above 8, and in this circumstance, it is better to separate these minerals from certain others by alkalinisation of the pulp. These general properties of collectors are also found when making use of the products according to the invention. However, variations in the rate of recovery as a function of pH, found with the adjuvants of the application, follow different curves from those of known collectors. They permit recovery and/or separation of minerals which is better than is given with standard adjuvants.

Whether it relates to the overall flotation of valuable species or to differential flotation for the separation of such species from one another, the collectors according to the invention are capable of increasing the efficacy of operation with respect to prior adjuvants. In particular, variations in the rate of recovery as a function of pH often allow a mineral to be obtained in a better yield at a pH around neutrality, which thus avoids the cost of acidification or alkalinisation of the pulp. On the other hand, as the difference between the rates of flotation of two different minerals is greater than with standard collectors, separation of these minerals is more effective. Examples 12 and 13 below illustrate these advantages of the invention.

The non-limiting examples which follow illustrate the application of the invention to various particular minerals. The mode of operation used in these examples comprises the treatment of a pulp constituted by 1 g of mineral in particles of 63 to 160 microns in 300 ml of water, the pulp being placed in a Hallimond cell. Under magnetic agitation, sulphuric acid or caustic soda solution is added in order to adjust the pH of the pulp to the desired value. After the addition of an appropriate quantity of the mercapto-ethanolic derivative in solution of ethyl alcohol to the pulp, a current of nitrogen at about 10 l/h is passed into the base of the cell through a No. 3 fritted filter. The flotation operation per se is effected for 3 minutes. The particles of the mineral entrained to the surface are recovered, dried and weighed. This thus determines the percentage quantity recovered by flotation of this mineral with respect to the pulp treated.

With the exception of Example 3, in which 0.5 ml of a 1/1000 alcoholic solution of the collector was utilised, all the other tests were effected with 0.1 ml of such a solution, which corresponds to 100 g of collector per tonne of mineral. By way of comparison, no collector was added in the case of Example 1. All the tests were effected at ambient temperature. The table below gives the results of these tests.

| Example No. | Mineral | Collector | pH | % of mineral recovered |
|---|---|---|---|---|
| 1 | Galena | none | 3 | 10 |
| 2 | " | Dodecyl-2-thio-ethanol | 4 | 97 |
| 3* | " | Dodecyl-2-thio-ethanol | 9.5 | 94 |
| 4 | " | Tetradecyl-2-thio-ethanol | 3.5 | 82 |
| 5 | Chalco-pyrite | Dodecyl-2-thio-ethanol | 4 | 95 |
| 6 | Chalco-pyrite | Dodecyl-2-thio-ethanol | 10 | 78 |
| 7 | Chalco-pyrite | Tetradecyl-2-thio-ethanol | 3.5 | 85 |
| 8 | Blende | Dodecyl-2-thio-ethanol | 4 | 44 |
| 9 | " | Dodecyl-2-thio-ethanol | 10 | 29 |
| 10 | " | Tetradecyl-2-thio-ethanol | 3.5 | 29 |
| 11 | Pyrites | Tetradecyl-2-thio-ethanol | 3.5 | 50 |

*used 0.5 ml of solution of collector per thousand.

These results show that, by adequate adjustment of the pH, sharp separations of certain minerals can be obtained. For example, it is possible to separate chalcopyrite from pyrites better than by processes utilizing known collectors. It should be noted in this connection that potassium amyl xanthate, utilized in the prior art, only allows about 92% of chalcopyrite to be obtained (U.S. Pat. No. 4,022,686, Col. 14).

EXAMPLE 12

This example is illustrated by FIG. 1 of the accompanying drawing, which represents the graph of recovery rate for galena, plotted as a function of the pH of the pulp subjected to flotation.

Comparative flotation tests, similar to those of the foregoing Examples, were effected using galena with the xanthate collector known in the art as "PAX" (potassium amyl xanthate) and with one of the products according to the invention, dodecyl-2-thio-ethanol, $$C_{12}H_{25}—S—CH_2CH_2OH$$

It is known that flotation with the same collector can give variable results depending upon the origin and particle size range of the mineral, as well as the operative details. Thus, in order to have comparable conditions, in the present example, operation was carried out rigorously in the same fashion in the two series of tests (1) and (2), on two portions of the same galena pulp. The curve GA-1 was plotted from the percentage of galena recovered by flotation in the presence of dodecyl-2-thio-ethanol at different pH values. GA-2 is the corresponding curve obtained with the xanthate ("PAX") as the collector.

In the two cases, the quantities of collector were 80 g per tonne of galena. It can be seen that at a pH of about 4.8, the two collectors led to the same rate of recovery of 76%. But at pH=7.5, dodecyl-2-thio-ethanol (GA-1) still gave 75% recovery, while with the xanthate (GA-2) this fell to a minimum of 40%. Thus, it is at pH values in the region of 7 that operation is most economical, as acidification or alkalinisation of the pulp is not required.

Dodecyl-2-thio-ethanol thus has a marked advantage over xanthate. It permits recovery of galena in good yields over the whole pH range from 5.5 to 9 and particularly from 6 to 8.

EXAMPLE 13

FIG. 2 represents graphs of the rates of recovery of chalcopyrite and blende as a function of pH.

As in Example 12, completely comparable flotation tests were effected on the two minerals indicated:

CH-1: chalcopyrite with dodecyl-2-thio-ethanol,

CH-2: chalcopyrite with "PAX" xanthate,

BL-1: blende with dodecyl-2-thio-ethanol,

BL-2: blende with "PAX" xanthate. p It will be noted that, at pH values above about 5, the curve CH-2 of FIG. 2 passes below CH-1, that is to say at these pH values the flotation yield of chalcopyrite with dodecyl-2-thio-ethanol is greater than that given with the known xanthate collector.

The contrary is given for blende, the curve BL-2 being above BL-1. It thus follows that the difference between the curves CH-1 and BL-1 is greater than that between CH-2 and BL-2. This shows that the separation of chalcopyrite from blende is greater by flotation in the presence of dodecyl-2-thio-ethanol than with xanthate. Thus, for example at pH 7.5, the percentages of mineral recovered are:

| | chalcopyrite | blende | difference |
|---|---|---|---|
| with xanthate (CH—2-BL—2) | 87.5 | 68 | 19.5 |
| with $C_{12}H_{25}$—S—$CH_2CH_2OH$ (CH—1-BL—1) | 94 | 64 | 30 |

There is thus a gradient of 30 instead of 19.5 which contributes to the enrichment of chalcopyrite accompanied by blende, when utilizing as the collector the product according to the invention in place of the usual xanthate. To arrive at the same result with the latter, it is necessary to adjust the pH to about 9.5, which requires a supplementary operation with supply of the basic reactant. It can be seen that, contrary to standard collectors, those of the invention give recoveries of chalcopyrite superior to 90% over a range of pH values from 6 to 8, that is to say in the vicinity of neutrality.

EXAMPLE 14

By the same method as in the foregoing Examples, the percentage of recovery of galena by flotation was determined, on the one hand, with dodecyl methyl sulphide, $C_{12}H_{25}SCH_3$, and on the other, with the standard "PAX" xanthate. The proportion of collector was calculated so as to represent 80 g per tonne of pulverised galena. The table below gives the percentage of mineral recovered at different pH values of the pulp.

| pH | $C_{12}H_{25}SCH_3$ | Xanthate |
|---|---|---|
| | % | % |
| 5 | 75.0 | 75.0 |
| 6 | 64.5 | 52.5 |
| 7 | 52.5 | 41.0 |
| 8 | 56.0 | 42.5 |
| 9 | 60.0 | 50.0 |

These results show that, starting at pH 5, the sulphide according to the invention gave better rates of recovery than the usual collector.

The sulphide of this Example can be replaced by other analagous R—S—R′ sulphides, where R is a $C_{12}$ to $C_{18}$ alkyl group and R′ is a $C_1$ to $C_6$ alkyl group.

EXAMPLE 15

The technique of the foregoing Examples was applied to flotation tests in the presence of myristyl-thia-acetic acid, that is to say tetradecyl-thia-methylene-carboxylic acid, or tetradecyl-thia-2-acetic acid $C_{14}H_{29}$—S—$CH_2COOH$.

The proportion of this collector was 80 g per ton of mineral. With chalcopyrite at pH values of 4.5 to 6, the results were still better than for the collectors according to the invention of the preceding Examples. As FIG. 3 shows, the rate of flotation then attained 98%.

For blende, there was a rapid fall at pH 5.5 and an even more abrupt one for pyrites above pH 3.5. These facts are very interesting since they allow an excellent separation of these minerals from chalcopyrite or from galena. FIG. 3 clearly illustrates this advantage. This figure also shows the facility with which the useful minerals separate from quartz and dolomite.

It is to be noted that the tests at pH values above 7 are affected after the addition of NaOH to the pulp. It can thus be considered that in this case the collector is in the form of its sodium salt, $C_{14}H_{29}$—S—$CH_2COONa$.

EXAMPLE 16

Flotations effected as in Example 15, but with dodecyl-thiaacetic acid, $C_{12}H_{25}$—S—$CH_2COOH$, in place of myristyl-thiaacetic acid led to similar results, but with a decrease in the percentage of mineral recovered at pH>7 which was:

greater for chalcopyrite, less for galena, blende and pyrites.

Thus, the following percentages were found:

| | pH 5.5 | pH 7 | pH 10 |
|---|---|---|---|
| chalcopyrite | 96 | 95.5 | 86 |
| galena | 89 | 80 | 20 |
| blende | 82 | 45 | 12 |
| pyrites | 55 | 16 | 7 |

This shows the extended possibilities for the collectors according to the invention. According to needs in each particular case, it is possible to choose a suitable thio compound of R and R′ appropriate to the task to be effected.

EXAMPLE 17

Following the mode of operation of the foregoing Examples, flotation tests for chalcopyrite were effected with 100 g of palmityl-thia-acetic acid, $C_{16}$—$H_{33}$—S—$CH_2COOH$, at 100 g per tonne of mineral and, in parallel, with 100 g per tonne of potassium amyl-xanthate ("PAX"-known commercial collector).

The following percentages of mineral recovered, as a function of pH were found:

| pH | $C_{16}H_{33}SCH_2COOH$ | K amyl-xanthate | Without collector |
|---|---|---|---|
| 4.25 | 93 | 91 | 31 |
| 5 | 92 | 87 | 26 |
| 6 | 85 | 73 | 19 |
| 7 | 72 | 62 | 16 |
| 8 | 73 | 66 | 17 |
| 9 | 76 | 80 | 21 |
| 10 | 86 | 88 | 23 |

It will be seen that up to pH 8, palmityl-thia-acetic acid is clearly more advantageous than the known xanthate.

We claim:

1. A process of flotation of sulphide minerals, by using 10 to 500 ppm of a collector comprising a thio-organic compound, with respect to the weight of the mineral to be flotated, wherein the collector is an organic sulfide of the type R—S—$(CH_2)_n$—OH, in which R is a $C_xH_y$ hydrocarbon radical where x is an integer from 2–20 and y is an integer from 2–41 and in which n is an integer from 1–18.

2. A process of flotation of one or more sulfide minerals according to claim 1, which comprises forming a pulp with said collector, establishing a desired pH, and effecting flotation.

3. A process according to claim 2, wherein the mineral is at least one of chalcopyrite and galena and is carried out with the pH of the pulp adjusted to 6 to 8.

4. A process according to claim 1 in which x is an integer from 2–18 and n is an integer of 1–6.

5. A process according to claim 4 in which x is an integer of 6–18.

6. A process according to claim 5 in which the amount of the collector is 30–200 ppm.

7. A process according to claim 5 or 6 in which the pH is 3.5–10.

8. A process according to claim 7 in which said collector is dodecyl-2-thio-ethanol or tetradecyl-2-thio-ethanol.

* * * * *